United States Patent [19]

Keritsis et al.

[11] Patent Number: 4,458,700

[45] Date of Patent: Jul. 10, 1984

[54] PROCESS FOR INCREASING THE FILLING POWER OF TOBACCO LAMINA FILLER HAVING A LOW INITIAL MOISTURE CONTENT

[75] Inventors: Gus D. Keritsis, Richmond; H. Howard Sun, Midlothian, both of Va.

[73] Assignee: Philip Morris Incorporated, New York, N.Y.

[21] Appl. No.: 368,873

[22] Filed: Apr. 15, 1982

[51] Int. Cl.[3] ..... A24B 3/18

[52] U.S. Cl. ..... 131/296

[58] Field of Search ..... 131/296, 290

[56] References Cited

U.S. PATENT DOCUMENTS

| | | | |
|---|---|---|---|
| 1,789,435 | 1/1931 | Hawkins | 131/296 |
| 2,344,106 | 3/1944 | Reed | 131/296 |
| 2,596,183 | 5/1952 | Sowa | 131/296 |
| 2,656,841 | 10/1953 | Gurley | 131/296 |
| 3,409,022 | 11/1968 | de la Burde | 131/296 |
| 3,409,023 | 11/1968 | de la Burde | 131/296 |
| 3,409,027 | 11/1968 | de la Burde | 131/296 |
| 3,409,028 | 11/1968 | de la Burde | 131/296 |
| 3,425,425 | 2/1969 | Hind | 131/296 |
| 3,529,606 | 9/1970 | de la Burde | 131/296 |
| 3,734,104 | 5/1973 | Buchanan | 131/296 |
| 3,742,961 | 7/1973 | Waller | 131/296 |
| 3,842,846 | 10/1974 | Laszlo | 131/296 |
| 3,978,867 | 9/1976 | Wochnowski | 131/296 |
| 3,982,550 | 9/1976 | de la Burde | 131/296 |
| 4,040,431 | 8/1977 | Ashworth et al. | 131/296 |
| 4,044,780 | 8/1977 | Kelly | 131/296 |
| 4,161,953 | 7/1979 | Glock | 131/296 |
| 4,195,647 | 4/1980 | Wochnowski | 131/296 |
| 4,211,243 | 7/1980 | Ohno | 131/296 |
| 4,235,250 | 11/1980 | Utsch | 131/296 |
| 4,244,381 | 1/1981 | Lendvay | 131/291 |
| 4,253,249 | 11/1980 | Psaras et al. | 131/296 |
| 4,366,825 | 1/1983 | Utsch et al. | 131/296 |

FOREIGN PATENT DOCUMENTS

| | | | |
|---|---|---|---|
| 0977235 | 11/1975 | Canada | 131/296 |
| 0980206 | 12/1975 | Canada | 131/296 |
| 0738726 | 8/1943 | Fed. Rep. of Germany | 131/291 |
| 1280684 | 7/1972 | United Kingdom | 131/296 |
| 1293735 | 10/1972 | United Kingdom | 131/296 |

*Primary Examiner*—Vincent Millin

[57] ABSTRACT

A process is disclosed for increasing the filling power of tobacco lamina filler having an OV value, immediately before treatment, within the range of from about 1% to about 10%, preferably from about 2% to about 7%, without the use of exogenous impregnants by contacting the filler with a high velocity gaseous medium at elevated temperature such that heat is rapidly and substantially uniformly transferred from the medium to the filler for a total contact time sufficient to stiffen and expand the filler.

10 Claims, No Drawings

PROCESS FOR INCREASING THE FILLING POWER OF TOBACCO LAMINA FILLER HAVING A LOW INITIAL MOISTURE CONTENT

BACKGROUND OF THE INVENTION

This invention relates to the art of increasing the filling power of tobacco lamina filler. More particularly, this invention relates to a process whereby the filling power of tobacco lamina filler having a low initial moisture content and which may have been previously treated to increase its filling power, is increased without the use of exogenous puffing or blowing agents.

During curing, the moisture content of tobacco leaves is greatly reduced resulting in shrinkage of the leaf structure and a decrease in filling power. Additionally, the shredding or cutting techniques generally employed to convert the cured tobacco leaves into filler may result in some lamination and compression of the tobacco, thereby decreasing the filling power even further. Many processes have been devised for increasing the filling power of cured tobacco for reasons well known in the art.

The heretofore known processes may be broadly characterized as involving penetration or impregnation of the tobacco with impregnants (blowing or puffing agents) which when removed during a subsequent expansion process step generate elevated pressure in and expand the tobacco.

Among the impregnants which have been employed are pressurized steam, air, water, organic solvents, ammonia, carbon dioxide, combinations of ammonia and carbon dioxide, and compounds capable of liberating a gas when subjected to chemical decomposition, as by heating. Among the means disclosed for removing the impregnant to expand the cell walls are a sudden reduction in pressure, freeze-drying, convection heating, radiant transfer (infrared), and the application of a microwave field.

While a number of the known processes may be employed to provide a satisfactory expanded tobacco product, which may then be blended with an unexpanded tobacco and formed into cigarettes or the like, the known processes do possess certain disadvantages. The use of certain impregnants, such as halogenated hydrocarbons which are foreign to tobacco, may not be completely satisfactory because some of the materials employed are not always desired as additives and the introduction, in considerable concentration, of such foreign materials presents the problem of removing the expansion agent after the treatment has been completed in order to avoid affecting aroma and other properties of the smoke. Moreover, aside from the aforementioned disadvantages, the use of such foreign materials adds to the overall cost of producing tobacco end products.

The earlier reported processes employing water as the impregnant tend to produce a more satisfactory result with tobacco stems than with tobacco lamina filler. One belief was that the lamina cellular structure was difficult to impregnate and that therefore most of the water remained on the surface. This belief may have motivated some of those skilled in the art to try vacuum impregnation and longer bulking times. More recent processes employing water as the impregnant have been successful in substantially increasing the filling power of tobacco lamina filler when water was used as the sole impregnant in an amount, measured as oven volatiles, within the range of from 20% 80% for one process, preferably 30% to about 80%, and 8% to about 30% for a second process, preferably 10% to 14%. These processes teach away from the use of OV values below their respective broader ranges.

DEFINITIONS

As used herein, the following terms have the indicated meanings.

Filling Power

The ability of tobacco to form a firm cigarette rod at a given moisture content. A high filling power indicates that a lower weight of tobacco is required to produce a cigarette rod of a given circumference and length than is required with a tobacco of lower filling power. Filling power is increased by stiffening tobacco and also by expanding tobacco.

Cylinder Volume (CV)

The volume that a given weight of shredded tobacco occupies under a definite pressure. The CV value is expressed as cc/10 g. To determine this value, tobacco filler weighing 10.000 g. is placed in a 3.358-cm. diameter cylinder, vibrated for 30 seconds on a "Syntron" vibrator, and compressed by a 1875 g. piston 3.33 cm. in diameter for 5 minutes; the resulting volume of filler is reported as cylinder volume. This test is carried out at standard environmental conditions of 23.9° C. and 60% relative humidity (RH). A high Cylinder Volume indicates a high Filling Power.

Equilibrium Cylinder Volume ($CV_{eq.}$)

The cylinder volume determined after the tobacco filler has been equilibrated by conditioning a 23.9° C. and 60% RH for 18 hours.

Oven-Volatiles Content (OV)

A unit indicating the moisture content (or percentage of moisture) in tobacco filler. It is determined by weighing a sample of tobacco filler before and after exposure in a circulating air oven for three hours at 100° C. The weight loss as a percentage of initial weight is the oven-volatiles content. The weight loss is attributable to volatiles in addition to water but OV is used interchangeably with moisture content and may be considered equivalent thereto since, at the test conditions, not more than about 1% of the tobacco filler weight is volatiles other than water.

Equilibrium Oven-Volatiles Content ($OV_{eq.}$)

The OV value determined after the tobacco filler has been equilibrated by conditioning at 23.9° C. and 60% RH for 18 hours.

Specific Volume (SV)

The volume of a predetermined amount of tobacco divided by the weight of the tobacco. The SV value is expressed as cc/g. The "$SV_{acetone}$" value may be determined by a simple application of the weight in air vs. weight in liquid method by placing a one-gram sample of tobacco in a tea ball which is then weighed, submerged in acetone, and reweighed. $SV_{Hg}$ is determined by placing a known weight of a tobacco sample in a sealed chamber of known volume and weight and then evacuating the air in the cylinder to a pressure of 1 tor. An amount of mercury is then admitted to the sample chamber in a manner such that the interfacial pressure between the mercury and the tobacco limits the intrusion of mercury into the porous structure. The volume of mercury displaced by the tobacco sample of known weight at an interfacial pressure of 1 to 2 psi absolute is expressed as $SV_{Hg}$ in cc/g. The $SV_{Hg}$ values reported below were determined by this method employing a porosimeter equipped with a low pressure filling device which was manufactured by AMINCO, Silver Springs, Md. Specific Volume differs from Cylinder Volume in that the tobacco is not compressed. It has been observed that as Specific Volume increases, Filling Power also increases.

Equilibrium Specific Volume ($SV_{eq.}$)

The SV value determined after the tobacco filler has been equilibrated by conditioning at 23.9° C. and 60% RH for about 18 hours.

Tobacco Lamina Filler

Shredded, cured tobacco exclusive of the stems (or veins). The cured tobacco may be of any type, and may be cased or uncased. Burley, bright, Oriental and blends thereof are preferred.

Exogenous Impregnant

A substance in solid, liquid or gaseous form, other than water, which is added to tobacco for its function as a blowing or puffing agent during an expansion step.

SUMMARY OF THE INVENTION

The present invention relates to a process for increasing the filling power of tobacco lamina filler (also referred to hereinafter as "the filler") having a low initial moisture content, and which may have been previously treated to increase its filling power, by contacting the filler with a high velocity gaseous medium at elevated temperature such that heat is rapidly and substantially uniformly transferred from the gaseous medium to the filler for a total contact time sufficient to stiffen and expand the filler.

The filler immediately before it is treated by being contacted with the gaseous medium is free of exogenous impregnants and has an OV value within the range of from about 1% to about 10%, preferably from about 2% to about 7%. The total contact time will vary depending on the percent increase in filling power desired, the initial OV value of the filler, and the rate of heat transfer. As an upper limit, the total contact time has a practical limit at the point at which charring of the filler occurs. The gaseous medium preferably comprises at least about 65% steam, by volume, and is at a temperature of at least about 232° C. and a velocity of at least about 27 m/sec. The entire process is preferably conducted at atmospheric pressure.

DESCRIPTION OF THE INVENTION

According to the present invention, a process is provided for increasing the filling power of tobacco lamina filler having a low initial moisture content without the use of exogenous impregnants and which may be effectively employed at atmospheric pressure.

The filler may be from any cured tobacco whether cased or not, and is preferably selected from the group consisting of Burley, cased Burley, bright, cased bright, Oriental and cased Oriental lamina filler, and mixtures thereof. More preferably, the lamina filler is selected from the group consisting of Burley, cased Burley, bright, and cased bright lamina filler, and mixtures thereof. Whatever its source, the filler for use in the process of the invention, immediately before treatment, is free of exogenous impregnants and has a moisture content, measured as OV, within the range of from about 1% to about 10%, preferably from about 2% to about 7%.

It is a surprising aspect of the present invention that the filling power of tobacco lamina filler that has not previously been treated to increase its filling power is significantly increased even though immediately before treatment the filler is free of exogenous impregnants and has an OV value within the range of from about 1% to about 10%.

The filler is contacted with a high velocity gaseous medium at elevated temperature such that heat is rapidly and substantially uniformly transferred from the medium to the filler for a total contact time sufficient to stiffen and expand the filler. It has been discovered that the combination of rapid and substantially uniform heat transfer with the relatively low initial moisture content of the tobacco results in a stiffening and expansion of the tobacco which combine to produce significant increases in filling power. It has been observed that the rate of heat transfer must be rapid in order to achieve the stiffening or modulus change, and the expansion or geometric change.

In order to obtain a constant and optimal result, it is important that the heat be substantially uniformly transferred to the filler. Thus, the filler must be contacted with the gaseous medium in such a way as to provide a substantially uniform contact between the shreds and the heat transfer medium. If such steps are not taken to insure substantially uniform heat transfer, the product will only be partially stiffened and expanded and thus will contain portions of filler which may be considered to be untreated.

The gaseous medium with which the filler is contacted is at atmospheric pressure and preferably contains steam. When steam is employed, preferably dry steam, it is preferred to employ at least about 65% by volume with the remainder of the volume of the gaseous medium comprising air or an inert gas, such as nitrogen or argon, or the like.

The volume of steam, the velocity and temperature of the gaseous medium, the contact time, and the rate at which the filler is contacted with the gaseous medium are all interrelated. Since the lamina filler is in shreds or strips, the velocity must be sufficient to provide uniform contact of the gaseous medium with the surface area of the shreds at the rate at which the filler is introduced into contact with the gaseous medium. These two parameters will, in turn, be influenced to some degree by the temperature and total contact time selected. It has been determined that the velocity should be at least about 27 m/sec., and preferably about 33 m/sec. to about 43 m/sec.

The temperature of the gaseous medium should be at least 232° C. It has been observed that if the temperature of the gaseous medium is below 232° C., the filling power of the tobacco lamina filler is not as significantly increased as when temperatures of at least 232° C. are employed. It is preferred that the gaseous medium be at a temperature within the range of from 232° C. to about 370° C. and, more preferably, at a temperature within the range of from about 288° C. to about 360° C. When temperatures in excess of 370° C. and up to about 485° C. are employed to achieve greater increase in cylinder volume, it is necessary to greatly reduce the contact time to avoid the undue darkening or browning and the burning or charring which can result from overheating the filler.

The filler is contacted with the gaseous medium for a time sufficient to increase its filling power. The contact time at a minimum must be sufficient to allow for an increase in the filling power of the filler and at a practical maximum is limited by the contact time which results in burning of the filler. The contact time is interrelated with the temperature and velocity, and thus the minimum and maximum contact time will vary with variation of the temperature and velocity values within their permissible ranges. These parameters may, of course, be selected to achieve a predetermined amount of increase in the filling power of the filler.

Generally, the total contact time will be less than about 10 seconds and may be as low as 0.1 second. Total contact times of up to about 12 seconds have been employed but particularly good results have been observed when employing total contact times within the range of from 1 second to about 6 seconds and more particularly within the range of from 1 second to about 4 seconds. A preferred minimum contact time is about 1 second.

The filler is introduced into contact with the gaseous medium at a rate effective to provide a substantially uniform and constant rate of heat transfer from the gaseous medium to the filler. This rate will depend to some extent on the velocity of the gaseous medium which, in turn, is selected to provide for substantially uniform contact of the surface area of the shreds with the gaseous medium. Uniformity of heat transfer to the shreds in contact with the gaseous medium is important to insure a uniform increase in the filling power of the treated filler.

The rate of introduction of the filler into contact with the gaseous medium is typically within the range of from about 3 g/sec. to about 550 g/sec. and is selected from within that range to provide a substantially uniform and constant rate of heat transfer from the gaseous medium to the filler. The rate required may tend to vary within that range, depending upon the apparatus employed to carry out the process and, thus, the means by which the filler is contacted with the gaseous medium, as well as depending upon the degree of expansion desired. A preferred range is from about 3 g/sec. to about 135 g/sec. The filler is preferably contacted with the gaseous medium by being dispersed therein.

The rate of heat transfer is generally independent of the type of apparatus employed and though a means has not been devised by which the rate may be directly measured, the optimum rate of heat transfer may be established experimentally by adjusting the various operating parameters of the apparatus employed such that the treated filler has an OV value, immediately after being contacted with the heat transfer medium, of less than about 7%, preferably less than about 5%. It is particularly preferred that the OV value be within the range of from about 0.5% to about 3% immediately after being contacted with the heat transfer medium. A preferred minimum OV value is about 0.5%.

The post-treatment OV value of the filler is not, in and of itself, a critical parameter since the OV value of the filler may be gradually decreased to within that range over a period of hours, days, or even months without expansion of the filler. But, provided that an apparatus has been selected in which the filler may be substantially uniformly contacted with the gaseous medium and provided that the gaseous medium permits a rapid transfer of heat to the filler, then, by adjusting the heat content of the gaseous medium and the total contact time of the filler with the medium, the post-treatment OV value will be within the aforementioned range when the parameters have been properly selected to provide a rapid and substantially uniform transfer of heat from the medium to the filler.

Any conventional apparatus which permits independent control of the parameters of steam content, velocity, contact time, temperature, and rate of introduction of the filler into contact with the gaseous medium, may be employed. One conventional and preferred apparatus is a dispersion dryer, generally known in the art as a "tower". The treated tobacco may desirably be passed through a separator immediately after treatment if a tower is employed.

When the process of the present invention is practiced employing a tower, the various parameters, such as the tobacco rate, must be adjusted and/or the tower must be adapted to provide for a substantially uniform transfer of heat from the gaseous medium to the filler at the optimum rate of heat transfer. When operating a relatively small tower, such as an 8 cm. or a 20 cm. tower, substantially uniform transfer of the heat from the gaseous medium to the filler may be realized by adjusting the tobacco feed rate so that the tobacco is substantially uniformly dispersed in the gaseous medium and the optimum heat transfer rate may be established by adjusting the temperature, velocity, and steam content of the gaseous medium to provide a rapid and optimum rate of heat transfer at the selected initial moisture content of the filler.

With 8 cm. and 20 cm. towers, when the various parameters are selected to provide for contact of the filler with the gaseous medium such that heat is rapidly and substantially uniformly transferred from the medium to the filler, the OV value of the treated filler will generally be within the range of from about 1% to about 5%. If the process is scaled up to commercial operation employing larger towers, such as 61 cm. towers, the various parameters must be adjusted and, in some instances, it is contemplated that the structure of the tower will have to be adapted to provide for the optimum rate of heat transfer. The optimum rate of heat transfer will be substantially the same regardless of the tower employed.

When tobacco lamina filler has been treated according to the present process, the resulting filler is much drier than desired for further processing or use. Therefore, to avoid breakage and to insure satisfactory smoking qualities, it is preferred that the treated filler be reordered (rehumidified) to a moisture level in equilibrium with normal use conditions before it is handled and processed. Typically, the treated filler will be reordered to an OV value within the range of from about 11% to about 13%. Any conventional means known to the art may be employed.

The process of the present invention results in a treated filler which not only exhibits a large increase in $CV_{eq}$ over the $CV_{eq}$ of the filler before treatment, but also exhibits an increase in SV, stiffness, and thickness relative to the filler before treatment. Accordingly, the filler is both expanded and stiffened during treatment. Since the process of the present invention may be effectively employed with either cased or uncased tobacco lamina filler, various flavorings and additives generally employed in the art may be applied to the filler either prior to or after treatment.

The filler treated according to the process of the present invention may be used as the sole tobacco ingredient in the manufacture of cigarettes or other smoking articles or it may first be mixed with other tobaccos to provide a desired blend. The treated filler is particularly suited to being incorporated in cigarettes since no materials foreign to the tobacco are used in the present process and thus no residual foreign material is left in the treated filler to affect taste during smoking. Thus the present invention includes within its scope both the treated filler produced according to the present process and also smoking articles, such as cigarettes, which include this product.

The following examples present illustrative but non-limiting embodiments of the present invention. Comparative examples are also presented.

EXAMPLES

Unless otherwise indicated, in each example the filler was bright tobacco lamina filler free of exogenous impregnants (hereinafter "the bright filler") and was contacted with the gaseous medium by being fed at the rate of about 181 g/min. into an 8 cm. tower equipped with a cyclone separator for a total contact time of about 2 seconds and in which the velocity of the gaseous medium in the tower was about 38 m/sec.

EXAMPLE 1

Eight portions of the bright filler having an initial $CV_{eq.}$ and $OV_{eq.}$ as indicated below for the control were treated according to the present process to increase their filling power. Four portions were treated at an initial OV of 10% and four portions were dried to an OV value of 5% in an oven at 60° C. and then treated. The gaseous medium employed was hot air at four different temperatures. The results are simmarized below in Table I.

TABLE I

| Tower Temp., °C. | Feed OV, % | Tower Exit OV, % | $CV_{eq.}/OV_{eq.}$, (cc/10 g/%) |
|---|---|---|---|
| Control | — | — | 34.0/11.8 |
| 232 | 5 | 2.4 | 34.0/11.8 |
| 288 | 5 | 1.9 | 45.0/11.3 |
| 316 | 5 | 1.4 | 53.0/11.0 |
| 343 | 5 | 1.4 | 69.0/10.4 |
| 232 | 10 | 4.0 | 36.0/11.9 |
| 288 | 10 | 2.7 | 45.0/11.2 |
| 316 | 10 | 2.3 | 49.0/11.2 |
| 343 | 10 | 2.1 | 61.0/10.5 |

EXAMPLE 2

Example 1 was repeated as set forth above except that the gaseous medium comprised 68% steam, by volume. The results are summarized below in Table II.

TABLE II

| Tower Temp., °C. | Feed OV, % | Tower Exit OV, % | $CV_{eq.}/OV_{eq.}$, (cc/10 g/%) |
|---|---|---|---|
| Control | — | — | 34.0/11.8 |
| 232 | 5 | 2.3 | 45.0/11.1 |
| 288 | 5 | 2.0 | 66.0/10.6 |
| 316 | 5 | 1.8 | 86.0/10.6 |
| 343 | 5 | 1.4 | 113.0/9.9 |
| 232 | 10 | 3.1 | 48.0/11.4 |
| 288 | 10 | 2.6 | 64.0/10.6 |
| 316 | 10 | 2.1 | 78.0/10.8 |
| 343 | 10 | 2.7 | 97.0/10.5 |

EXAMPLE 3

Three portions of the bright filler having an initial OV of 5.6% obtained by freeze-drying 20.3% OV filler were treated according to the present process to increase their filling power. The $CV_{eq.}$ and $OV_{eq.}$ values for the control were obtained by allowing the filler at 5.6% OV to equilibrate at standard controlled conditions. The gaseous medium employed was 100% steam at three different temperatures. The results are summarized below in Table III.

TABLE III

| Tower Temp. °C. | Feed OV, % | $CV_{eq.}/OV_{eq.}$ (cc/10 g/%) |
|---|---|---|
| Control | 5.6 | 30.6/13.1 |
| 288 | 5.6 | 80.6/10.7 |
| 329 | 5.6 | 102.0/10.3 |
| 357 | 5.6 | 112.0/10.3 |

EXAMPLE 4

Three portions of the bright filler at 30.2% OV, 21.9% OV and 13.7% OV, respectively, were processed through an 8 cm. tower containing, as the gaseous medium, 100% steam at 343° C. and 40.8 m/sec. Each treated portion was then divided into two samples, one of which was run through the tower with the gaseous medium at 288° C. and the other with the gaseous medium at 343° C. The initial or feed OV for each sample was the exit OV of the treated portion from which it was derived. The results are summarized below in Table IV.

TABLE IV

| | Feed OV, % | Tower Exit OV, % | Tower Exit SV, cc/g | $SV_{eq.}$, cc/g | $CV_{eq.}$, cc/10 g | $OV_{eq.}$, % |
|---|---|---|---|---|---|---|
| Controls | 30.2 | — | — | 0.95 | 35.2 | 13.0 |
| | 21.9 | — | — | 0.92 | 34.3 | 12.9 |
| | 13.7 | — | — | 0.92 | 36.4 | 12.9 |
| First | 30.2 | 4.4 | 2.18 | 1.82 | 69.1 | 11.1 |
| Treatment | 21.9 | 1.0 | 2.21 | 2.04 | 69.1 | 11.5 |
| (comparative) | 13.7 | 3.3 | 2.70 | 2.24 | 85.7 | 10.6 |
| 343° C. | | | | | | |
| Second | 4.4 | 1.3 | 2.26 | 2.02 | 71.8 | 9.9 |
| Treatment | 1.0 | 0.7 | 2.13 | 2.32 | 79.5 | 9.8 |
| 288° C. | 3.3 | 0.6 | 2.28 | 2.43 | 83.5 | 9.4 |
| Second | 4.4 | 0.9 | 3.06 | 2.74 | 97.4 | 10.0 |
| Treatment | 1.0 | 0.7 | 3.26 | 2.87 | 102.8 | 9.8 |
| 343° C. | 3.3 | 1.3 | 3.42 | 3.06 | 105.2 | 8.9 |

EXAMPLE 5

Example 4 was repeated as set forth above, except that the first treatment was conducted employing a gaseous medium (100% steam) at 288° C. instead of 343° C. The results are summarized below in Table V.

TABLE V

| | Feed OV, % | Tower Exit OV, % | Tower Exit SV, cc/g | $SV_{eq.}$, cc/g | $CV_{eq.}$, cc/10 g | $OV_{eq.}$, % |
|---|---|---|---|---|---|---|
| First | 30.2 | 6.1 | 1.56 | 1.47 | 52.7 | 11.5 |
| Treatment | 21.9 | 5.1 | 1.56 | 1.40 | 50.5 | 11.0 |
| (comparative) | 13.7 | 2.3 | 1.82 | 1.46 | 58.0 | 11.0 |
| 288° C. | | | | | | |
| Second | 6.1 | 1.9 | 2.39 | 1.87 | 66.9 | 10.6 |
| Treatment | 5.1 | 0.9 | 2.71 | 1.80 | 66.0 | 10.2 |
| 288° C. | 2.3 | 1.1 | 2.84 | 2.00 | 75.1 | 9.7 |
| Second | 6.1 | 0.7 | 2.66 | 2.41 | 83.7 | 10.5 |
| Treatment | 5.1 | 0.7 | 2.70 | 2.65 | 93.0 | 10.2 |
| 343° C. | 2.3 | 0.6 | 3.12 | 2.59 | 97.4 | 9.8 |

EXAMPLE 6

A portion of the bright filler at 13.3% OV was processed through the 8 cm. tower containing, as the gaseous medium, 100% steam at 357° C. and then the treated filler was again processed through the same tower under the same tower conditions. The exit OV of the filler after the first treatment was also the feed OV for the second treatment. The results are summarized below in Table VI.

TABLE VI

| | Feed OV, % | $SV_{eq.}$, cc/g | $CV_{eq.}$, cc/10 g | $OV_{eq.}$, % | Tower Exit OV, % | % Increases $CV_{eq.}$ | % Increases $SV_{eq.}$ |
|---|---|---|---|---|---|---|---|
| Control | 13.3 | 0.92 | 31.9 | 13.0 | — | — | — |
| First Treatment (comparative) 357° C. | 13.3 | 2.41 | 85.0 | 10.8 | 1.9 | 166.5 | 162.0 |
| Second Treatment 357° C. | 1.9 | 3.18 | 116.9 | 9.5 | 0.6 | 266.5 | 246.0 |

We claim:

1. A process for increasing the filling power of tobacco lamina filler comprising contacting the filler with a high velocity gaseous medium at elevated temperature such that heat is rapidly and substantially uniformly transferred from the medium to the filler for a total contact time sufficient to stiffen and expand said filler, said medium being at a temperature of at least 232° C., said filler being free of exogenous impregnants and having an OV value immediately before being contacted with said medium within the range of from about 1% to about 10%.

2. The process of claim 1 wherein the OV value, immediately before treatment, is within the range of from about 2% to about 7%.

3. The process of claim 1 or 2 wherein the filler is contacted with said gaseous medium by being substantially uniformly dispersed therein.

4. The process of claim 3 wherein the gaseous medium comprises at least about 65% steam by volume.

5. The process of claim 4 wherein the gaseous medium is at a temperature within the range from 232° C. to about 485° C.

6. The process of claim 3 wherein the total contact time is from about 0.1 to about 12 seconds.

7. The process of claim 3 wherein the filler, immediately after being contacted with the gaseous medium, has an OV value of less than about 5%.

8. The process of claim 1 wherein the filler has been previously treated to increase its filling power.

9. The process of claim 1 including reordering the treated filler.

10. A stiffened and expanded tobacco lamina filler product produced according to the process of claim 1 or 8.

* * * * *

UNITED STATES PATENT AND TRADEMARK OFFICE

CERTIFICATE OF CORRECTION

PATENT NO. : 4,458,700

DATED : July 10, 1984

INVENTOR(S) : Gus D. Keritsis and Howard Sun

It is certified that error appears in the above-identified patent and that said Letters Patent is hereby corrected as shown below:

Col. 1, line 68, after "20%" insert -- to --

Signed and Sealed this

*Nineteenth* Day of *March 1985*

[SEAL]

*Attest:*

DONALD J. QUIGG

*Attesting Officer*

*Acting Commissioner of Patents and Trademarks*